US008031894B2

(12) United States Patent
Perkins et al.

(10) Patent No.: US 8,031,894 B2
(45) Date of Patent: Oct. 4, 2011

(54) NON-OCCLUDING EAR MODULE FOR A PERSONAL SOUND SYSTEM

(75) Inventors: Rodney Perkins, Woodside, CA (US); Andy P. Atamaniuk, Redwood City, CA (US); Caslav V. Pavlovic, Palo Alto, CA (US); Nicholas R. Michael, San Francisco, CA (US)

(73) Assignee: Sound ID, Palo Alto, CA (US)

( * ) Notice: Subject to any disclaimer, the term of this patent is extended or adjusted under 35 U.S.C. 154(b) by 735 days.

(21) Appl. No.: 11/909,154

(22) PCT Filed: Mar. 28, 2006

(86) PCT No.: PCT/US2006/011036

§ 371 (c)(1),
(2), (4) Date: Nov. 6, 2007

(87) PCT Pub. No.: WO2006/104981

PCT Pub. Date: Oct. 5, 2006

(65) Prior Publication Data

US 2009/0141921 A1 Jun. 4, 2009

Related U.S. Application Data

(60) Provisional application No. 60/666,018, filed on Mar. 28, 2005.

(51) Int. Cl.
*H04R 25/00* (2006.01)

(52) U.S. Cl. ..... 381/328; 381/380

(58) Field of Classification Search ..... 381/312, 381/328, 370, 371, 373, 376–379, 382
See application file for complete search history.

(56) References Cited

U.S. PATENT DOCUMENTS

2003/0165248 A1* 9/2003 Lenz et al. ..... 381/312
2003/0174853 A1* 9/2003 Howes et al. ..... 381/370

* cited by examiner

*Primary Examiner* — Brian Ensey
(74) *Attorney, Agent, or Firm* — Haynes Beffel & Wolfeld LLP

(57) ABSTRACT

An ear module with an interior lobe (200) housing a speaker (58) and adapted to fit within the Concha (103) of the outer ear, and an exterior lobe (300) housing data processing resources, includes a compressive member (202) coupled to the interior lobe (200) and providing a holding force between the anti-helix (101) and the forward wall (108) of the ear canal (102) near the tragus (104). The interior lobe (200) extends into the exterior opening (110) of the ear canal (102), and includes a forward surface (210) adapted to fit against the forward wall (108) of the ear canal (102), and a rear surface (211) facing the anti-helix (101). The width of the extension (201) (in a dimension orthogonal to the forward surface (210) of the extension (201)) between the forward surface (210) and the rear surface (211) from at least the opening of the ear canal (102) to the tip (203) of the extension (201) is substantially less than the width of the ear canal (102), leaving an open air passage (250).

13 Claims, 8 Drawing Sheets

NON-OCCLUDING EAR MODULE FOR A PERSONAL SOUND SYSTEM

RELATED APPLICATIONS

This application is a 371 of PCT/US06/11036 filed on 28 Mar. 2006, entitled "Non-Occluding Ear Module For A Personal Sound System" which claims benefit of U.S. Provisional Application 60/666,018 filed 28 Mar. 2005, entitled "Personal Hearing System."

BACKGROUND OF THE INVENTION

1. Field of the Invention

The present invention relates to ear modules for personal sound systems, adapted to be worn on the ear and provide audio processing.

2. Description of Related Art

Ear modules, including head-phones, earphones, head sets, hearing aids and the like, are adapted to be worn at the ear of a user and provide personal sound processing. A wide variety of such devices has been developed to deal with the problems of secure positioning at the ear and comfort for the user. One technique to secure an ear module is based on a fitting adapted to fit within the concha of the outer ear, including a compressive member providing a holding force between the anti-helix and the forward wall of the ear canal beneath the tragus. See, Patent Publication No. US 2003/0174853 A1, entitled Anti-Helix-Conforming Ear-Mount for Personal Audio Set, published Sep. 18, 2003. While such devices have been found to satisfactorily secure an ear piece with relative ease of use, the mechanisms have occluded the ear canal, preventing free air passage into the ear canal. Indeed, it has been a design goal for some of such devices to minimize "pneumatic leakage" between the ear canal and the ear piece. However, without adequate air flow into the ear canal, the devices are found to be uncomfortable for many users.

It is desirable to provide an ear module that can be secured safely to the ear without occluding the ear canal, and that is suitable for housing audio processing resources.

SUMMARY OF THE INVENTION

An ear module is described herein including an interior lobe housing a speaker and adapted to fit within the concha of the outer ear, an exterior lobe housing data processing resources, and a compressive member coupled to the interior lobe and providing a holding force between the anti-helix and the forward wall of the ear canal near the tragus. An extension of the interior lobe is adapted to extend into the exterior opening of the ear canal, and includes a forward surface adapted to fit against the forward wall of the ear canal, and a rear surface facing the anti-helix. The width of the extension (in a dimension orthogonal to the forward surface of the extension) between the forward surface and the rear surface from at least the opening of the ear canal to the tip of the extension is substantially less than the width of the ear canal, leaving an open air passage. The extension fits within the concha and beneath the tragus, without filling the concha and leaving a region within the concha that is in air flow communication with the open air passage in the ear canal. The compressive member tends to force the forward surface of the extension against the forward wall of the ear canal, securing the ear module in the ear comfortably and easily and maintaining the open air passage open.

In embodiments of the ear module described herein, the shape of the interior lobe within the region is adapted to fit within the concha so that it does not lie flush with the surface of the ear, leaving air gaps at irregularities in the surface of the ear or in the surface of the interior lobe, establishing an opening from outside air through the concha into the open air passage in the ear canal. Also, the interior lobe extends outwardly to support the exterior lobe of the ear module in a position spaced away from the anti-helix and tragus. Thus, air flow is provided to the open-air passage in the ear canal around the exterior and the interior lobes of the ear module, even in embodiments in which the exterior lobe is larger than the opening of the concha. Embodiments of the compressive member include an opening exposing the region within the concha that is in air flow communication with the open air passage in the ear canal to outside air. The opening in the compressive member, the region in the concha beneath the compressive member, and the open air passage in the ear canal provide an un-occluded air path from free air into the ear canal.

The ear-level module is a component of a personal sound system. The ear-level module houses a radio for transmitting and receiving communication signals encoding audio data, an audio transducer, one or more microphones, a user input and control circuitry. In embodiments of the technology, the ear-level module is configured with hearing aid functionality for processing audio received on one or more of the microphones according to a hearing profile of the user, and playing the processed sound back on the audio transducer. The control circuitry includes logic for communication using the radio with a plurality of sources of audio data in memory storing a set of variables for processing the audio data. Logic on the ear-level module is operable in a plurality of signal processing modes. In one embodiment, the plurality of signal processing modes include a first signal processing mode (e.g. a hearing aid mode) for processing sound picked up by one of the one or more microphones using a first subset of the set of variables and playing the processed sound on the audio transducer. A second signal processing mode (e.g. a companion microphone mode) is included for processing audio data from a corresponding audio source received using the radio according to a second subset of the set of variables, and playing the processed audio data on the audio transducer. A third signal processing mode (e.g. a phone mode) is included for processing audio data from another corresponding audio source, such as a telephone, and received using the radio. The audio data in the third signal processing mode is processed according to a third subset of the set of variables in played on the audio transducer. The ear level module includes logic that controls switching among the first, second and third signal processing modes according to predetermined priority, in response to user input, and in response to control signals from the plurality of sources. Other embodiments include fewer or more processing modes as suits the needs of the particular implementation.

A structure for an ear level module in a personal sound system is provided to fit securely within the ear, to be comfortable, and to support sophisticated microelectronics at the ear level, without occluding air flow into the ear canal.

Other aspects and advantages of the present invention can be seen on review of the drawings, the detailed description and the claims, which follow.

DETAILED DESCRIPTION

A detailed description of embodiments of the present invention is provided with reference to the FIGS. 1-9.

Figure 1:
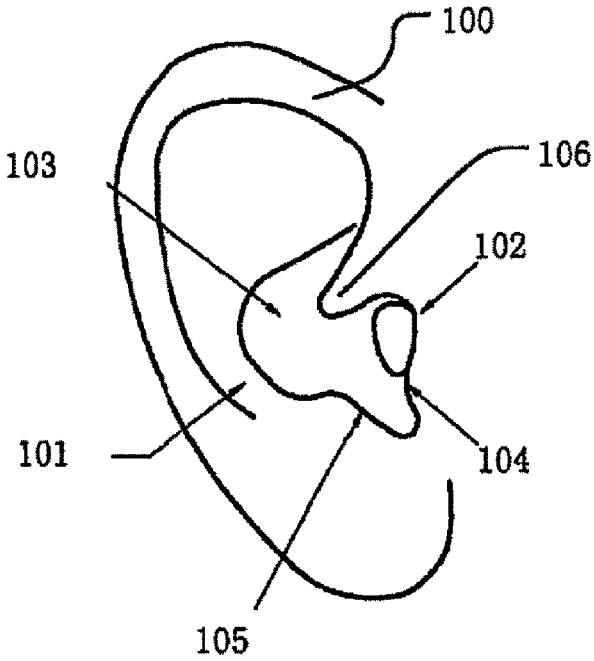
FIG. 1 is a simplified diagram of an outer ear.

FIG. 1 is a simplified diagram of an outer ear, or auricle, which is described here for the purposes of context. The outer ear includes the helix 100 which is the outer frame of the auricle typically with a rolled up edge. The antihelix 101 is a folded "Y" shaped part of the ear between the helix 100 and the ear canal 102. The region between the antihelix 101 and the helix 100 is known as the scapha. The hollow bowl like portion fixed to the ear canal 102 and framed by the antihelix 101 is the concha 103. The tragus 104 is a small projection just in front of the ear canal 102. The anti-tragus 105 is the lower cartilaginous edge of the concha. The distance A between the forward wall 108 (see FIG. 2) of the ear canal 102 to the antihelix 101 ranges widely. For example, an ear module can be designed for a target ear within a range of ear sizes in which the distance A can vary from about 20 to 35 mm. The width of the concha 103 between the anti-tragus 105 and the ridge 106 of the helix 100 as it enters the concha 103 ranges widely also. For example, an ear module can be designed for a target ear within a range of ear sizes in which width of the concha 103 can vary from about 10 to 20 mm. It will be understood that the device described herein is designed for fitting within a target ear, which has dimension relevant to the fit of the ear module falling within respective ranges of sizes.

Figure 2:
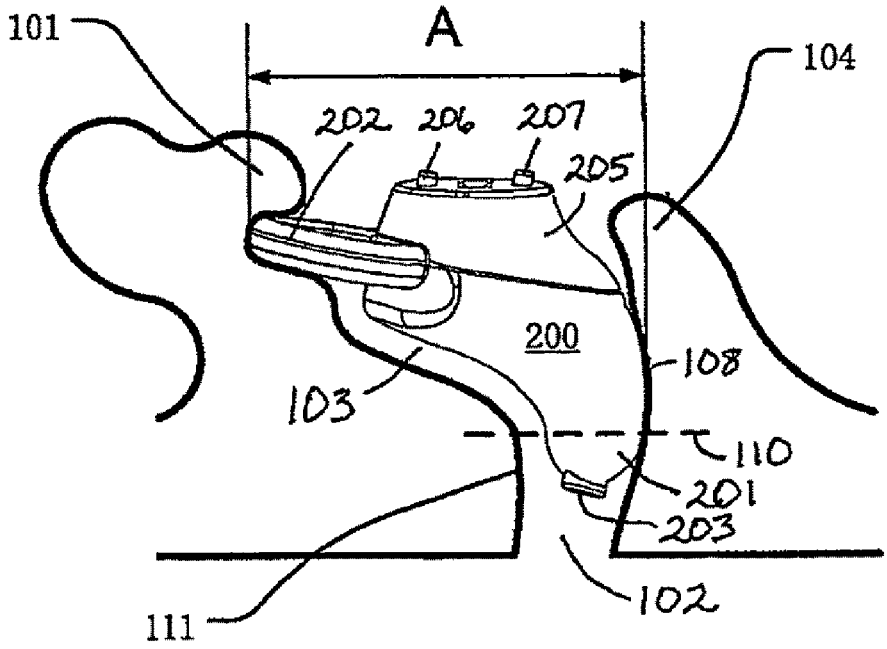
FIG. 2 illustrates the fit of the interior lobe of the ear module within the ear.

FIG. 2 illustrates the interior lobe 200 of the ear module, and its fit within the ear from a section view between the tragus 104 and the antihelix 101. The interior lobe 200 includes an extension 201 adapted to extend into the exterior opening 110 of the ear canal 102. The ear module includes a compressive member 202 (referred to herein as an ear loop) coupled to the interior lobe 200, providing a holding force between the antihelix 101 and the forward wall 108 of the ear canal 102 near the tragus 104. As illustrated, the extension 201 fits within the ear canal 102 without blocking the opening 110 of the ear canal between the forward wall 108 and the rear wall 111, into the concha 103. The tip 203 of the extension 201 on the interior lobe 200 of the ear module includes a speaker suitable for hearing aid functionality. As mentioned above, the distance A varies significantly for the target ear. The variation in the distance A for the target ear can be accommodated by providing the ear module in a kit that includes a number of various sizes of ear loops.

FIG. 2 illustrates the position of the opening 110 of the ear canal to the concha 103. The extension 201 has a width in a dimension orthogonal to the forward wall 108 of the ear canal at the opening 110, and over a length of the extension from at least the opening 110 to the tip 203 of the extension 201 that is substantially less than the width of the ear canal for the target ear size, leaving an open air passage through the ear canal into the concha 103. Although FIG. 2 shows the rear surface of the interior lobe 200 spaced away from the surface of the ear in the concha 103, in embodiments of the technology, the interior lobe 200 actually rests on the surface of the ear in his region. However, the shape of the surface of the conchae in this region is somewhat irregular compared to the surface of the interior lobe of the ear module, leaving air gaps. Therefore, the extension 201 and interior lobe 200 fit within the concha and beneath the tragus, without filling the concha, and leaving a region within the concha that is in air flow communication with the open air passage in the ear canal.

As illustrated in FIG. 2, the interior lobe 200 of the ear module has a widest point generally along the line between antihelix 101 and a forward wall 110 of the ear canal. The interior lobe 200 includes an upper extension 205 adapted to support an exterior lobe of the ear module in which the majority of the data processing resources are housed. Posts 206, 207 illustrated in FIG. 2 provide for coupling the interior lobe with the exterior lobe (not shown in FIG. 2). In one embodiment, the only component within the interior lobe 200 is the speaker at the tip 203. The upper extension 205 extends outwardly from the ear to support the exterior lobe of the ear module in a position spaced away from the antihelix and the tragus, so that an opening for outside air through the concha into the open air passage in the ear canal is provided around the exterior and interior lobes of the ear module.

Figure 3:
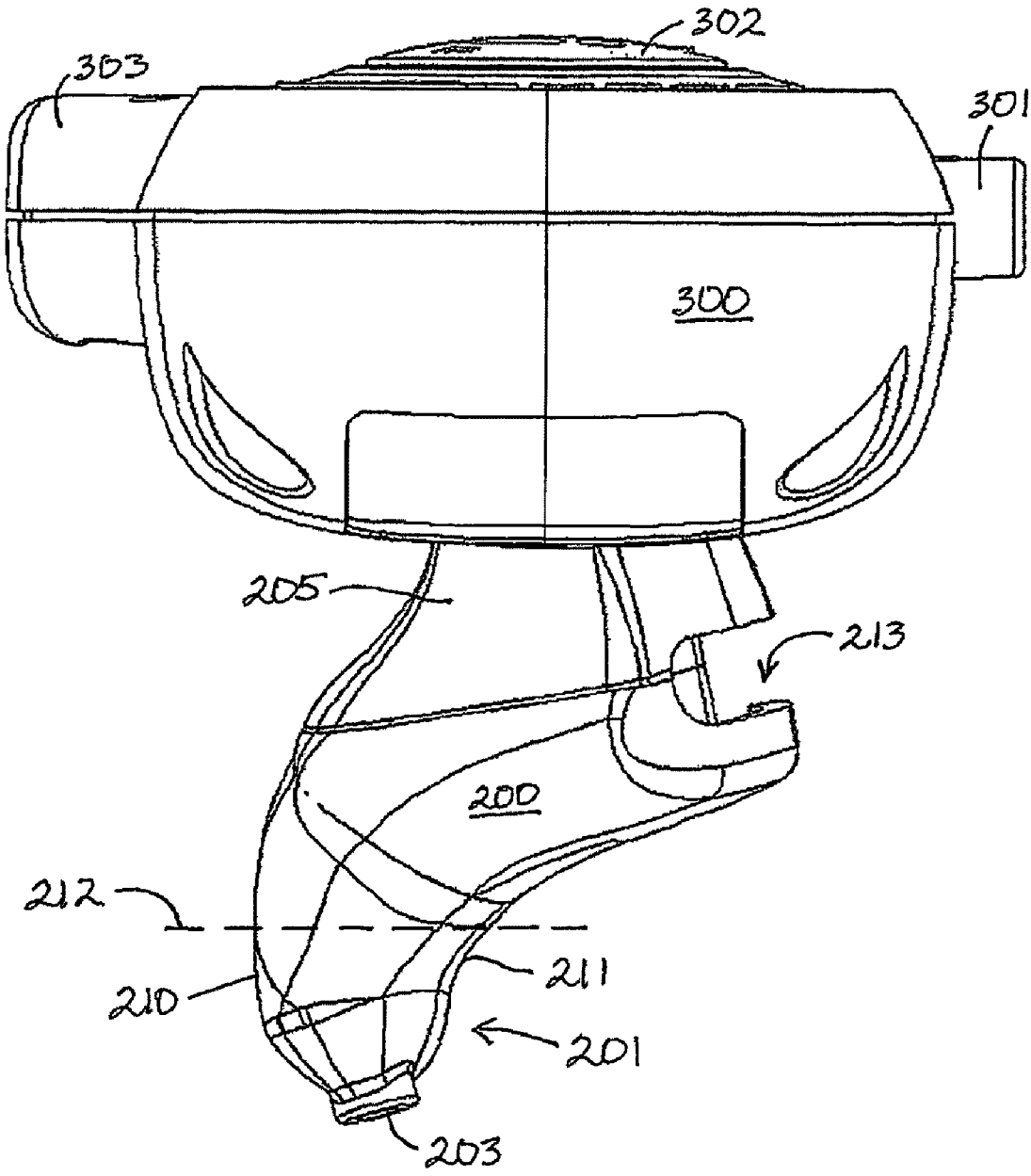
FIG. 3 is a top view of the ear module housing without the compliant ear loop.

FIG. 3 is a more detailed top view of the ear module including an exterior lobe 300 and the interior lobe 200. The interior lobe 200 has a forward surface 210 adapted to fit against the forward wall of the ear canal as described with reference to FIG. 2. The interior lobe 200 has a rear surface 211, opposite the forward surface 210. The dimension at a location 212 corresponding to the opening of the ear canal on a target ear is less than the width of the ear canal at the opening. For example, in a representative embodiment, the dimension at location 212 is about five millimeters leaving an air gap about one to two millimeters wide between a rear surface 211 and the rear wall of the ear canal (rear wall 111 in FIG. 2) in the target ear size.

The interior lobe 200 includes slot 213 adapted to receive a corresponding rail on an ear loop, to secure the ear loop onto the ear module. The exterior lobe 300 is substantially larger than the concha on the target ear, and houses data processing resources as mentioned above. In FIG. 3, a user input button 301 on the rear surface of the exterior lobe 300 and a user input button 302 on the outward surface of the module 300 are illustrated. Also, an extension 303 of the exterior lobe 300 adapted to house one or more microphones, including for example an omnidirectional microphone and a directional microphone directed at the mouth of the wearer, is included.

Figure 4:
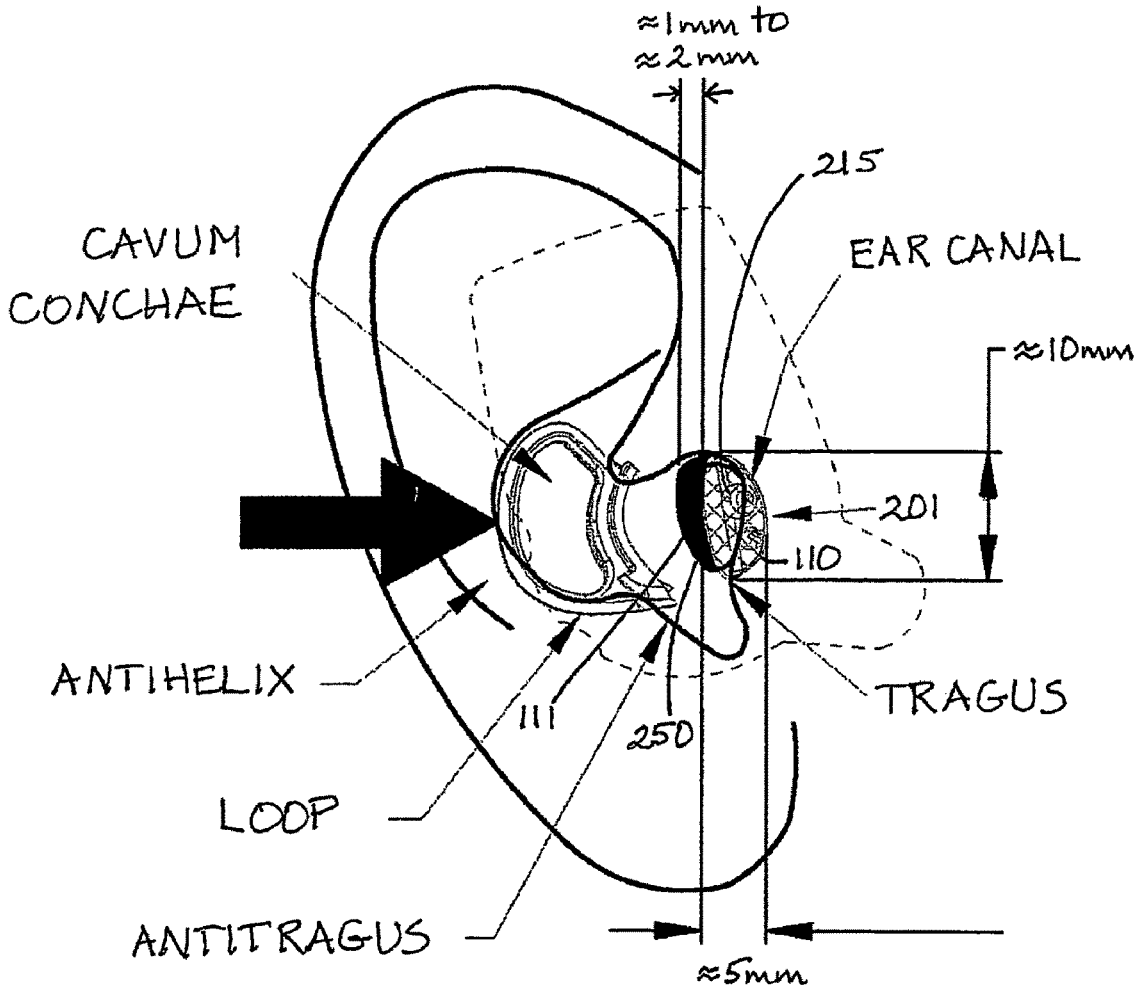
FIG. 4 is a top, cut away view illustrating fit of the interior lobe of the ear module housing within the ear canal and the concha.

FIG. 4 illustrates placement of the ear loop 202 (see FIG. 2) against the antihelix 101, and a slice 215 of the interior lobe 200 taken at the location 212 at the entrance of the ear canal beneath the tragus 104 on the target ear. The forward surface 210 of the slice 215 fits against the forward wall 110 of ear canal. The vertical dimension of the slice 215 is about 10 millimeters in the embodiment illustrated for the target ear. The horizontal dimension of the slice 215 is about five millimeters as illustrated in the figure for a typical target ear. An air gap 250 of about one to two millimeters wide between the slice 215 and a rear surface 111 of the ear canal is formed in the target ear.

Figure 5:
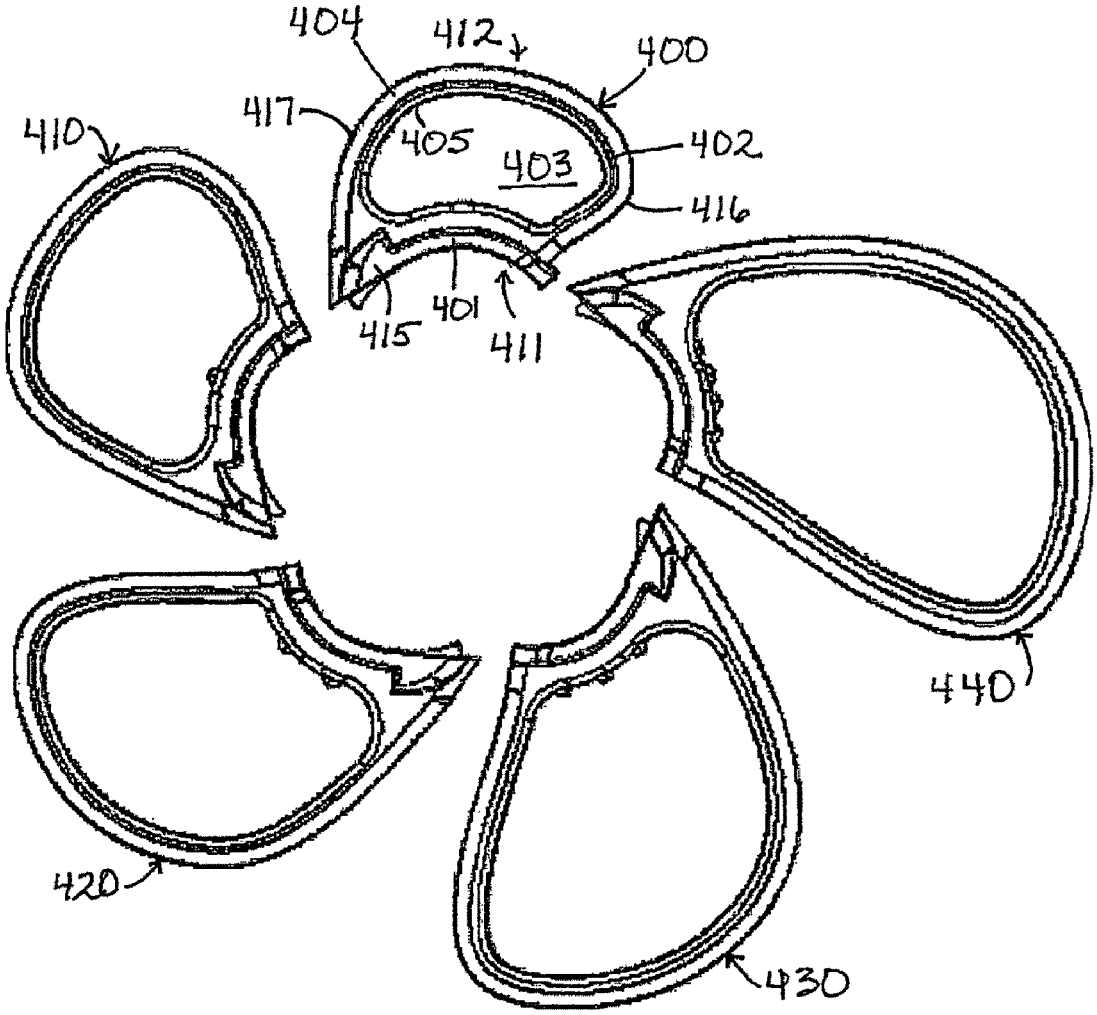
FIG. 5 is a side view of an ear loop adapted for use with the ear module.

FIG. 5 illustrates a set of ear loops 400, 410, 420, 430, 440, of various sizes. In the illustrated embodiment, an ear loop 400 is representative. The ear loop 400 is adapted to fit in the slot 213 on the interior lobe 200 of the ear module. The ear loop 400 includes a near side member 411 adapted to removeably couple with the interior lobe of the ear module. In the illustrated embodiment, the near side member includes a base rail 401 with a stop structure 415 adapted to fit within the slot 213 on the interior lobe 200 of the ear module and secure the loop 400 to the module. The loop 400 has a rim 402 having a shape adapted to fit against the anti-helix of a target ear. In the illustrated embodiment, the loop 400 includes a far side member 412 which has substantially the same shape in each member of the set. The loop 400 includes a pair of first and second linking side members having lengths selected for a target ear size. The loops 410, 420, 430 and 440 have near side members 411 and far side members 412 that have substantially the same shape, and have respective pairs of first and second linking side members 416, 417 which have different lengths to fit different sizes of ears. The first and second linking side members 416, 417 do not normally contact the ear over any significant portion of their lengths, improving the flexibility of the ear loop. A set of various sizes of the ear loop 400 is delivered in a kit with the ear module, so that the user may select the appropriate size. In one representative set of ear loops, ear loop 400 is adapted for fitting a target ear in which the distance A (FIG. 2) is about 23.3 mm; ear loop 410 is adapted for fitting a target ear in which the distance A is about 27.2 mm; ear loop 420 is adapted for fitting a target ear in which the distance A is about 28.6 mm; ear loop 430 is adapted for fitting a target ear in which the distance A is about 30.8 mm; ear loop 440 is adapted for fitting a target ear in which the distance A is about 32.8 mm.

The material of the loop 400 deforms when inserted in the ear, and provides compressive force against the interior lobe of the ear module. The loop 400 preferably includes an opening 403 inside the rim 402, which facilitates fit of the ear loop within the ear and provides for air flow into the open air passage within the ear canal. In the illustrated embodiment, the rim 402 includes a broader exterior rim 404 and a more narrow interior rim 405. The ear loops in the set can be made using a variety of flexible elastomer materials, such as a thermoplastic elastomer TPE suitable for injection molding. In one embodiment, a TPE having durometer of Shore A 64 was used. The material is selected empirically, so that it is not too hard for comfort and not too soft so that is stays within the ear.

Figure 6:
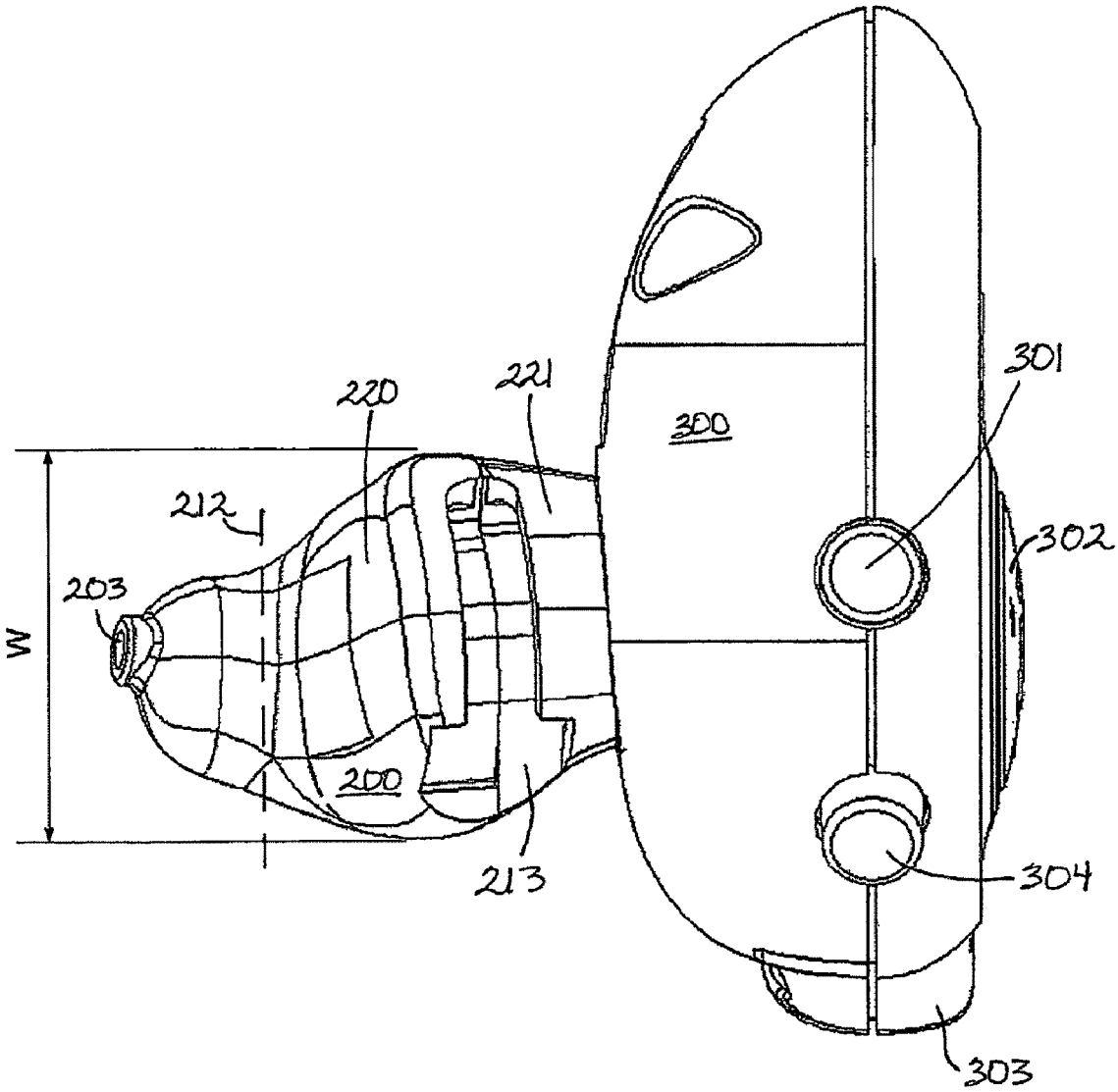
FIG. 6 is a view of the ear module housing from the rear.

FIG. 6 illustrates the ear module including the interior lobe 200 and the exterior lobe 300 from the rear facing toward the forward wall of the ear canal. The interior lobe 200 includes a surface 220 which is adapted to rest (unevenly) on the surface of the concha as described above. The interior lobe 200 includes the surface 221 which faces the antihelix, and in which the slot 213 is positioned to receive the ear loop. Interior lobe 200 is adapted to fit on a target ear so that the entrance of the ear canal 212 intersects the device near the location indicated. The interior lobe 200 has a width W in the illustrated embodiment which is about 14 mm. This dimension W can vary depending on the needs of a particular implementation for fit to a target ear, and to house components for the ear module. As illustrated in FIG. 6, the exterior lobe 300 is substantially larger than the concha, and is supported off of the ear so as not to block air flow into the open air passage in the ear canal.

Components of the exterior module 300 illustrated include the user interface button 301, a second user interface button 304, and the main interface button 302. In addition, the extension 303 which houses the microphones of the ear module from this view extends away and downwardly into the plane of the page.

Figure 7:
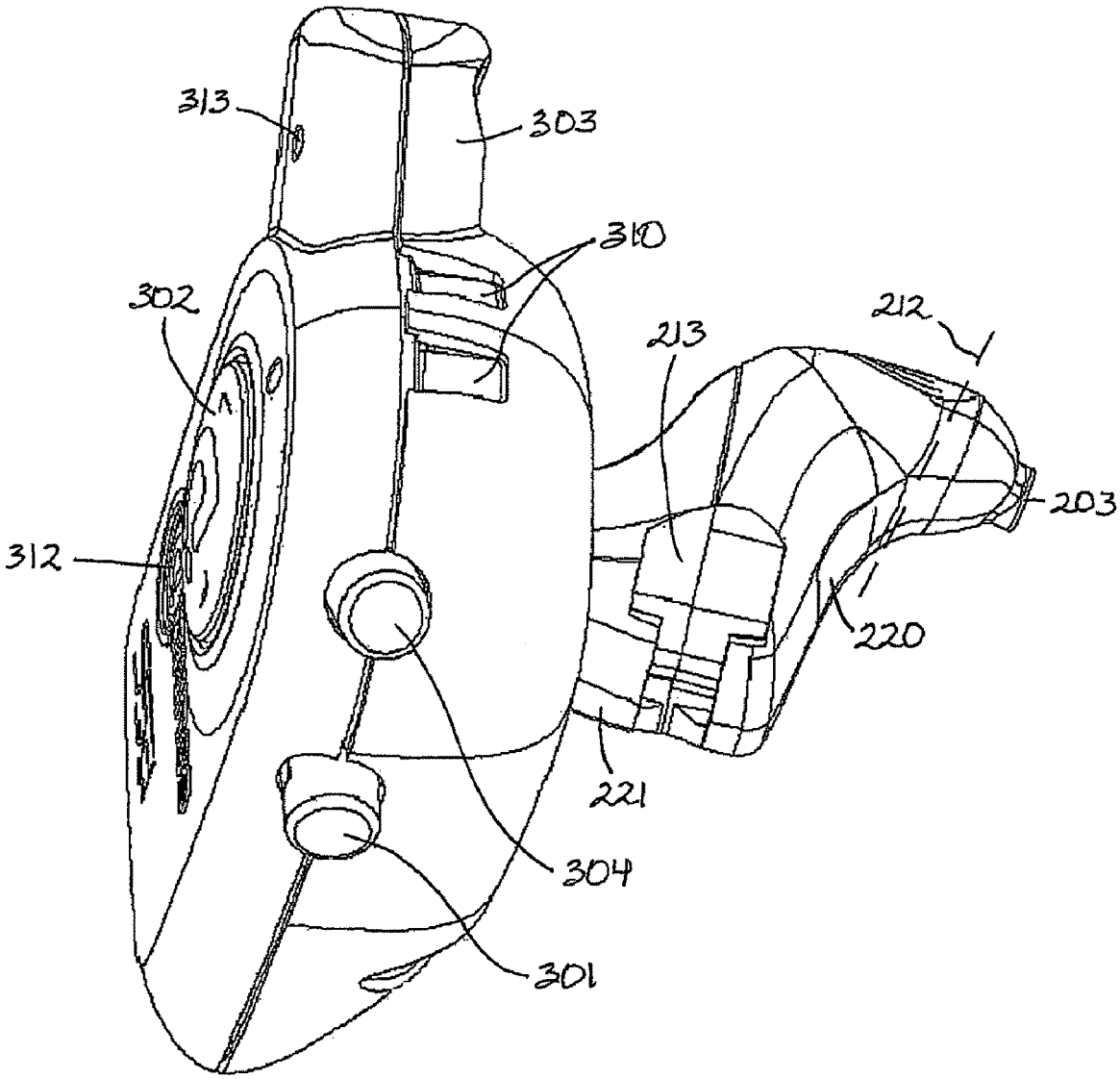
FIG. 7 is a prospective view of the ear module housing.

FIG. 7 illustrates another perspective view of the exterior lobe 300 and interior lobe 200 of the ear module. As illustrated, the exterior lobe 300 of ear module includes the user interface buttons 301, 302 and 304. In addition, an LED 312 is housed on the exterior lobe. The extension 303 includes opening 313 for the microphone or microphones within the extension. Embodiments of the ear module have two openings on the extension 303 and two openings on the outside surface of the exterior lobe of the ear module to support an omnidirectional microphone and a directional microphone. Contacts 310 are provided for coupling the exterior lobe 300 of the ear module onto corresponding contact pins in a recharging cradle. Components of the interior lobe 200 of the ear module are labeled with the same reference numerals used in earlier figures.

Figure 8:
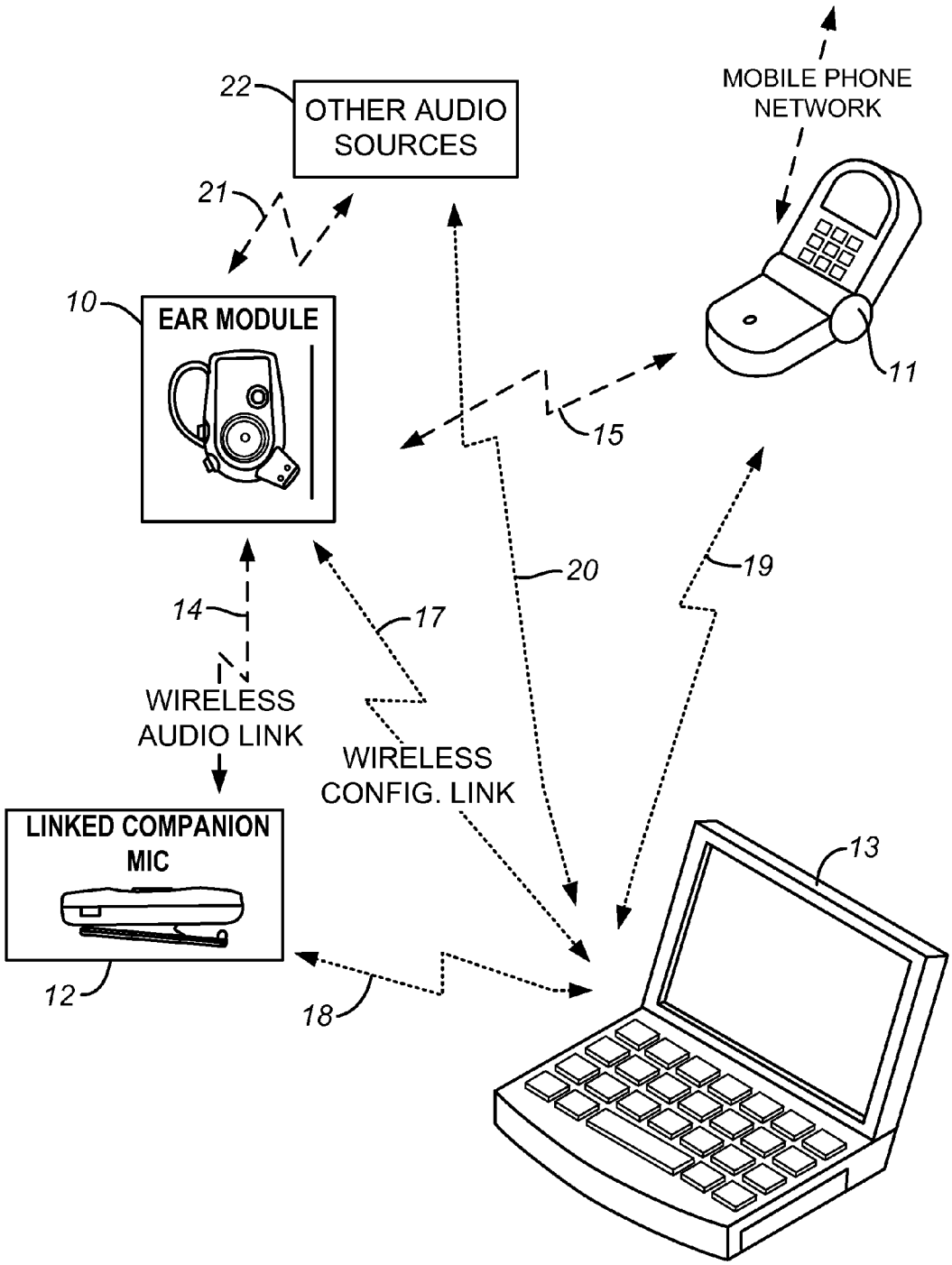
FIG. 8 illustrates a personal sound system including an embodiment of the ear module.

FIG. 8 illustrates a wireless network which extends the capabilities of an ear module 10, adapted to be worn at ear level, and operating in multiple modes. The ear module 10 preferably includes a hearing aid mode having hearing aid functionality. The network facilitates techniques for providing personalized sound from a plurality of audio sources such as mobile phones 11, other audio sources 22 such as televisions and radios, and with a linked companion microphone 12. In addition, wireless network provides communication channels for configuring the ear module 10 and other audio sources ("companion modules") in the network using a configuration host 13, which comprises a program executed on a computer that includes in interface to the wireless network. In one embodiment described herein, the wireless audio links 14, 15, 21 between the ear module 10 and the linked companion microphone 12, between the ear module 10 and the companion mobile phone 11, and between the ear module 10 and other companion audio sources 22, respectively, are implemented according to Bluetooth compliant synchronous connection-oriented SCO channel protocol (See, for example, Specification of the Bluetooth System, Version 2.0, 4 Nov. 2004). The wireless configuration links 17, 18, 19, between the configuration host 13 and the ear module 10, the mobile phone 11, the linked companion microphone 12, and the other audio sources 22 are implemented using a control channel, such as a modified version of the Bluetooth compliant serial port profile SPP protocol or a combination of the control channel and SCO channels. (See, for example, BLUETOOTH SPECIFICATION, SERIAL PORT PROFILE, Version 1.1, Part K:5, 22 Feb. 2001). Of course, a wide variety of other wireless communication technologies may be applied in alternative embodiments.

Companion modules, such as the companion microphone 12 consist of small components, such as a battery operated module designed to be worn on a lapel, that house "thin" data processing platforms, and therefore do not have the rich user interface needed to support configuration of private network communications to pair with the ear module. For example, thin platforms in this context do not include a keyboard or touch pad practically suitable for the entry of personal identification numbers or other authentication factors, network addresses, and so on. Thus, to establish a private connection pairing with the ear module, the radio is utilized in place of the user interface.

In embodiments of the network described herein, the linked companion microphone 12 and other companion devices may be "permanently" paired with the ear module 10 using the configuration host 13, by storing a shared secret on the ear module and on the companion module that is unique to the pair of modules, and requiring use of the shared secret for establishing a communication link using the radio between them. The configuration host 13 is also utilized for setting variables utilized by the ear module 10 for a processing audio data from the various sources. Thus in embodiments described herein, each of the audio sources in communication with the ear module 10 may operate with a different subset of the set of variables stored on the ear module for audio processing, where each different subset is optimized for the particular audio source, and for the hearing profile of the user. The set of variables on the ear module 10 is stored in nonvolatile memory on the ear module, and includes for example, indicators for selecting data processing algorithms to be applied and parameters used by data processing algorithms.

Figure 9:
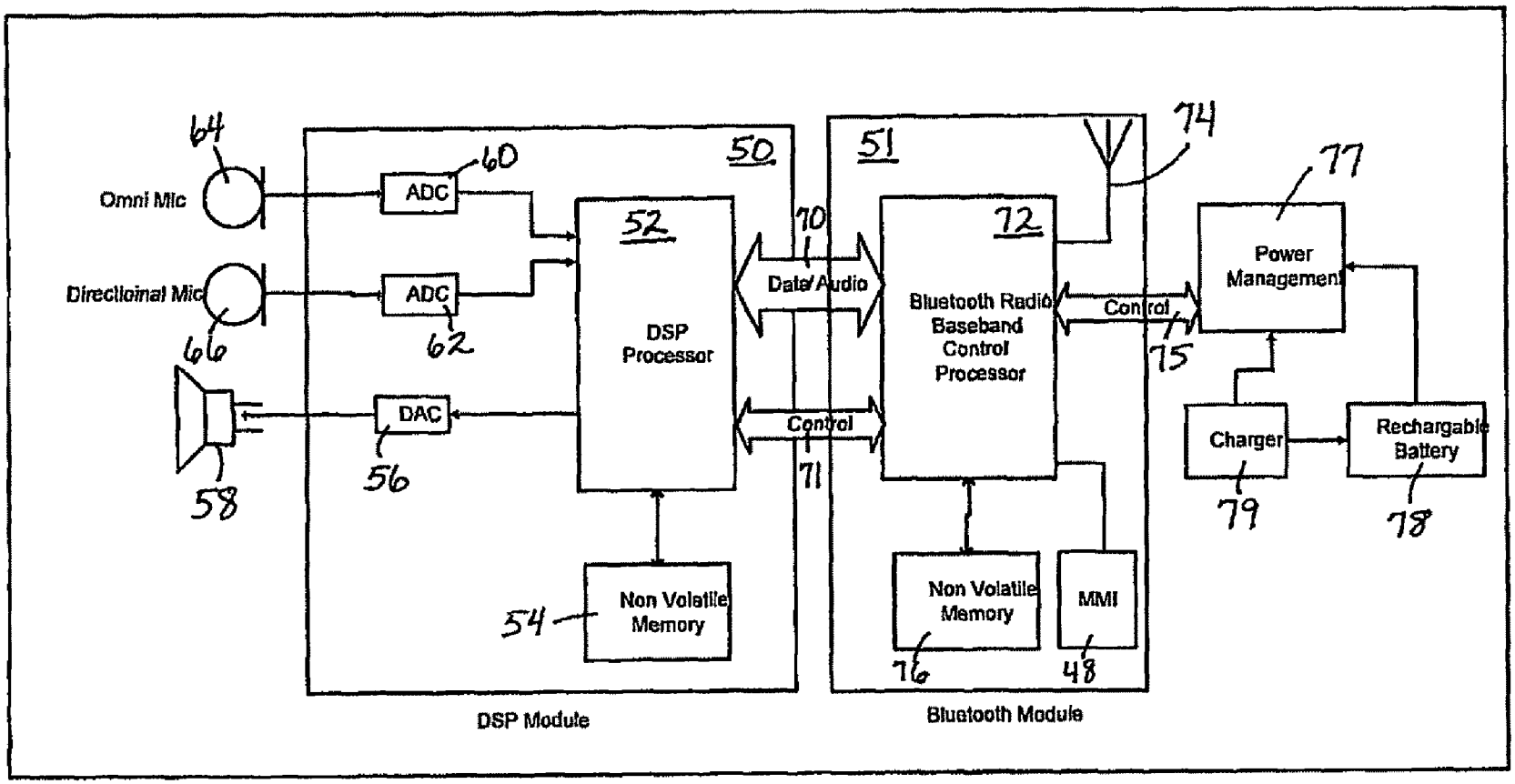
FIG. 9 is a simplified diagram of data processing resources within the ear module housing for an embodiment of the technology adapted for the personal sound system of FIG. 8.

FIG. 9 is a system diagram for microelectronic and audio transducer components of a representative embodiment of the ear module 10. The system includes a data processing module 50 and a radio module 51. The data processing module includes a digital signal processor 52 coupled to nonvolatile memory 54. A digital to analog converter 56 converts digital output from the digital signal processor 52 into analog signals for supply to speaker 58 at the tip of the interior lobe of the ear module. A first analog-to-digital converter 60 and a second analog-to-digital converter 62 are coupled to the omnidirectional microphone 64 and a directional microphone 66, respectively, on the exterior lobe of the ear module. The analog-to-digital converters 60, 62 supply digital inputs to the digital signal processor 52. The nonvolatile memory 54 stores computer programs that provide logic for controlling the ear module as described in more detail below. In addition, the nonvolatile memory 54 stores a data structure for a set of variables used by the computer programs for audio processing, where each mode of operation of the ear module may have one or more separate subsets of the set of variables, referred to as "presets" herein.

The radio module 51 is coupled to the digital signal processor 52 by a data/audio bus 70 and a control bus 71. The radio module 51 includes, in this example, a Bluetooth radio/baseband/control processor 72. The processor 72 is coupled to an antenna 74 and to nonvolatile memory 76. The nonvolatile memory 76 stores computer programs for operating a radio 72 and control parameters as known in the art. The radio processor module 51 also controls the man-machine interface 48 for the ear module 10, including accepting input data from the buttons and providing output data to the status light, according to well-known techniques.

A power control bus 75 couples the radio module 51 and the processor module 50 to power management circuitry 76. The power management circuitry 77 provides power to the microelectronic components on the ear module in both the processor module 50 and the radio module 51 using a rechargeable battery 78. A battery charger 79 is coupled to the battery 78 and the power management circuitry 77 for recharging the rechargeable battery 78.

The microelectronics and transducers shown in FIG. 9 are adapted to fit within the ear module 10.

The nonvolatile memory 76 is adapted to store at least first and second link parameters for establishing radio communication links with companion devices, in respective data structures referred to as "pre-pairing slots" in non-volatile memory. In the illustrated embodiment the first and second link parameters comprise authentication factors, such as Bluetooth PIN codes, needed for pairing with companion devices. The first link parameter is preferably stored on the device as manufactured, and known to the user. Thus, it can be used for establishing radio communication with phones and the configuration host or other platforms that provide user input resources to input the PIN code. The second link parameter also comprises an authentication factor, such as a Bluetooth PIN code, and is not pre-stored in the embodiment described herein. Rather, the second link parameter is computed by the configuration host in the field for private pairing of a companion module with the ear-module. In one preferred embodiment, the second link parameter is unique to the pairing, and not known to the user. In this way, the ear module is able to recognize authenticated companion modules within a network which attempt communication with the ear module, without requiring the user to enter the known first link parameter at the companion module. Embodiments of the technology support a plurality of unique pairing link parameters in addition to the second link parameter, for connection to a plurality of variant sources of audio data using the radio.

In addition, the processing resources in the ear module include resources for establishing a configuration channel with a configuration host for retrieving the second link parameter, for establishing a first audio channel with the first link parameters and for establishing a second audio channel with the second link parameter, in order to support a variety of audio sources.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

The invention claimed is:

1. An ear-level module to be worn on a target ear, the ear including an ear canal with an exterior opening, and having a forward wall and a rear wall with a width between the forward wall and the rear wall, a concha, an anti-helix and a tragus, the ear-level module comprising:

a housing;

a data processor and a radio on or in the housing;

the housing including an interior lobe housing a speaker and adapted to fit within the concha, and a compressive member coupled to the interior lobe and providing a holding force between the anti-helix and the forward wall of the ear canal near the tragus; wherein the interior lobe includes an extension adapted to extend into the exterior opening of the ear canal without blocking the opening, the extension having a forward surface adapted to fit against the forward wall of the ear canal, and a rear surface facing the anti-helix, the extension having a width in a dimension between the forward surface and a rear surface of the ear canal over a length of the extension from at least the opening of the ear canal to the tip of the extension that is substantially less that the width of the ear canal, leaving an open air passage through the ear canal.

2. The module of claim 1, wherein the extension fits within the concha and beneath the tragus, without filling the concha and leaving a region within the concha that is in air flow communication with the open air passage in the ear canal.

3. The module of claim 1, wherein the compressive member tends to force the forward surface of the extension against the forward wall of the ear canal, securing the ear module on the ear.

4. The module of claim 1, including an exterior lobe coupled to the interior lobe, and wherein the interior lobe extends outwardly to support the exterior lobe of the ear module in a position spaced away from the anti-helix and tragus, so that an opening from outside air through the concha into the open air passage in the ear canal is provided around the exterior and the interior lobes of the ear module.

5. An ear-level module to be worn on a target ear, the ear including an ear canal with an exterior opening, and having a forward wall and a rear wall with a width between the forward wall and the rear wall, a concha, an anti-helix and a tragus, the ear-level module comprising:

a housing for data processing resources including an interior lobe housing a speaker and adapted to fit within the concha and an exterior lobe coupled to the interior lobe, wherein the exterior lobe is larger than the concha;

a compressive member coupled to the interior lobe and providing a holding force between the anti-helix and the forward wall of the ear canal near the tragus; wherein the interior lobe includes an extension adapted to extend into the exterior opening of the ear canal without blocking the opening, the extension having a forward surface adapted to fit against the forward wall of the ear canal, and a rear surface facing the anti-helix, the extension having a width in a dimension between the forward surface and a rear surface of the ear canal over a length of the extension from at least the opening of the ear canal to the tip of the extension that is substantially less that the width of the ear canal, leaving an open air passage through the ear canal; and wherein the interior lobe extends outwardly to support the exterior lobe of the ear module in a position spaced away from the anti-helix and tragus, so that an opening from outside air through the concha into the open air passage in the ear canal is provided around the exterior and the interior lobes of the ear module.

6. The module of claim 1, wherein the compressive member includes an opening exposing a region within the concha that is in air flow communication with the open air passage in the ear canal.

7. The module of claim 1, the housing including an exterior lobe coupled to the interior lobe, and wherein the data processor and radio are mounted within the exterior lobe of the housing.

8. The module of claim 1, including a microphone within the housing, the data processor being adapted to process sound picked up by the microphone and play the processed sound on the speaker.

9. The module of claim 1, wherein the data processor is adapted to process sound received over the radio, and play the processed sound on the speaker.

10. The module of claim 1, wherein the compressive member comprises an elastomer loop, including a near side member adapted for coupling to the interior lobe of the ear module, a far side member with a curved shape adapted to fit against the anti-helix, and first and second linking side member coupling the near side member and the far side member.

11. The module of claim 10, including a set of compressive members, wherein compressive members in the set include respective near side members adapted for removeably coupling to the interior lobe of the ear module and far side members with said curved shape adapted to fit against the anti-helix, and have respective pairs of first and second linking side members which have different lengths to fit different sizes of ears.

12. An ear-level module to be worn on an ear, the ear including an ear canal with an exterior opening, and having a forward wall and a rear wall with a width between the forward wall and the rear wall, a concha, an anti-helix and a tragus, the ear-level module comprising:

a housing for data processing resources, including an interior lobe and an exterior lobe;

the interior lobe housing a speaker and adapted to fit within the concha, and a compressive member coupled to the interior lobe and providing a holding force between the anti-helix and the forward wall of the ear canal near the tragus; wherein the interior lobe includes an extension adapted to extend into the exterior opening of the ear canal without blocking the opening, the extension having a forward surface adapted to fit against the forward wall of the ear canal, and a rear surface facing the anti-helix, the extension having a width in a dimension between the forward surface and a rear surface of the ear canal over a length of the extension from at least the opening of the ear canal to the tip of the extension that is substantially less that the width of the ear canal, leaving an open air passage through the ear canal;

wherein the extension fits within the concha and beneath the tragus, without filling the concha and leaving a region within the concha that is in air flow communication with the open air passage in the ear canal;

wherein the compressive member tends to force the forward surface of the extension against the forward wall of the ear canal, securing the ear module on the ear and includes an opening exposing a region within the concha that is in air flow communication with the open air passage in the ear canal;

the exterior lobe coupled to the interior lobe, and wherein the interior lobe extends outwardly to support the exterior lobe of the ear module in a position spaced away from the anti-helix and tragus, so that an opening from outside air through the concha into the open air passage in the ear canal is provided around the exterior and the interior lobes of the ear module; and a radio, a microphone and a data processor within the housing, the data processor adapted to process sound picked up by the microphone and sound received over the radio, and play the processed sound on the speaker.

13. The module of claim 4, wherein the exterior lobe is larger than the concha.

* * * * *